United States Patent [19]

Tetro

[11] 4,431,140

[45] Feb. 14, 1984

[54] CONTINUOUS PRESSURE ROLL WINDER

[75] Inventor: Richard S. Tetro, Fulton, N.Y.

[73] Assignee: The Black Clawson Company, Middletown, Ohio

[21] Appl. No.: 325,444

[22] Filed: Nov. 27, 1981

[51] Int. Cl.[3] ..... B65H 19/20; B65H 75/34

[52] U.S. Cl. ..... 242/56 A; 242/58; 242/64

[58] Field of Search ..... 242/56 A, 58–58.4, 242/64–66

[56] References Cited

U.S. PATENT DOCUMENTS

| | | | |
|---|---|---|---|
| 3,345,009 | 10/1967 | Rockstrom | 242/56 A |
| 3,377,032 | 4/1968 | Jacobs et al. | 242/56 A |
| 3,478,975 | 11/1969 | Penrod | 242/64 |
| 3,687,387 | 8/1972 | Hilgeman | 242/56 A |
| 3,944,151 | 3/1976 | Lee et al. | 242/58.3 |

*Primary Examiner*—Leonard D. Christian
*Attorney, Agent, or Firm*—Biebel, French & Nauman

[57] ABSTRACT

A turret-type winder particularly adapted for winding of impervious sheet-type web materials, such as plastics, provides self-contained and pivotally mounted pressure rolls which contact the cores and the winding roll throughout the entire winding process and throughout the indexing of the arms from a core loading station to a roll unloading station while maintaining the relative geometry of contact such that the web contacts the pressure roll at or before contacting the winding roll for effectively excluding the entrapment of air between the winding layers.

A method of winding from a roll changer or other apparatus for providing a web of material includes the movement of the spindle end of the arms of a turret-type changer through the path of web leading to a winding roll to the back or remote side of the web so that the web lead is brought between the spindle arms and between the empty spindle and the winding roll. Thereafter, web transfer to a new core is accomplished by placing the web onto the core at a side of the core adjacent the axis of the turret, thereby providing movement of a self-contained pressure roll into coacting engagement with the core and the building or winding roll throughout the entire winding process at a region on the periphery of the core and the roll substantially at the web lead-in point and substantially at the nip for effectively excluding air throughout the entire winding process.

5 Claims, 9 Drawing Figures

CONTINUOUS PRESSURE ROLL WINDER

BACKGROUND OF THE INVENTION

This invention relates to web winding and more particularly to a continuous turret-type winder and to a method of winding a web in which a pressure roll is maintained in contact with a winding roll throughout the winding operation.

Turret-type winders have commonly been used with roll changers or accumulators by which each of a pair of core-supporting spindles carried on the ends of the turret arms are sequentially loaded with a core. The cut edge of a web is attached to the core by a suitable web transfer or enveloper apparatus. At a particular point in the build-up of the winding roll it is indexed through approximately 180° while the winding continues, to deliver the winding roll to an unloading station and to deliver a fresh core on the recently unloaded spindle of the turret arms to the web transfer station.

The continuous winding, on a turret-type winder of certain kinds of web materials, particularly non-porous materials such as plastic film, requires particular considerations in producing a roll which is uniformly wound. One important consideration is that of preventing air from being entrapped between the individual layers or wraps, so that succeeding wraps do not produce side slipping or otherwise produce a poorly wound roll. Thus, it has become common practice to employ a roll changer having a pressure roll positioned against the winding roll to control the hardness of the winding package. The function of the pressure roll is to expel the air layer at the incoming web and prevent this air from being trapped between the successive layers, which would otherwise make the completed wound package too soft or unstable. However, in turret-type winders, a particular problem presents itself in that during and following indexing of the winding roll, the winding roll of necessity moves away from the pressure roll on the roll changer apparatus.

The turret winder disclosed in the U.S. Patent of Penrod, No. 3,478,975 issued Nov. 18, 1969 to the assignee of this invention, was a successful improvement, particularly designed for impervious or non-porous web material such as plastic film. An auxiliary rider roll was pivotally mounted to the rotating turret structure and more particularly, on an arm pivoted to an offset arm forming an integral part of the turret structure. The turret-supported pressure roll could be brought against the winding roll even while it was still in the transfer station. This auxiliary pressure roll would take over the function of the pressure roll on the roll changer throughout the indexing motion of the turret and thereafter until the winding roll reached its maximum diameter, thereby reducing loss of continuity when the winding roll was moved, by the turret, out of the transfer station and into the loading station. However, due to the fact that the turret-supported pressure roll was designed to be used in conjunction with the primary pressure roll on the roll changer, in order to accommodate these rolls simultaneously at the beginning of the transfer function, it was necessary to position the auxiliary roll at a side of the core which was generally opposite from the web lead-in side and from the pressure roll associated with the roll changer. Accordingly, the auxiliary rider roll contacted the winding roll at a position spaced somewhat arcuately from the tangent line which the oncoming web formed with the roll, and the effectiveness of the turret-supported rider roll in eliminating entrained air between the wraps was substantially reduced as compared to the effectiveness of the pressure roll on the roll changer, which contacted the web just prior to its forming a nip with the building roll. Thus, due to this somewhat decreased effectiveness, variations in package hardness sometimes occurred where the outermost wraps were formed under the influence of only the auxiliary riding roll.

The turret-winder apparatus as disclosed in the Penrod patent was conventional to the extent that the new core could be loaded onto the spindle at the unloading station after the previously wound roll had been removed. This newly wound core could then be indexed by the turret to the web transfer station while the web was being wound on the other spindle. Guide rolls were provided on arms set at an angle to the primary spindle arms which were designed to engage the web during transfer and guide it under the turret apparatus to the winding roll. The path of the web from the roll changer to the turret was such that the web remained outside the rotational path of the turret as the newly placed core was indexed to the web transfer station. Thus, after cutting and transferring by the conventional enveloping apparatus, the web engaged the newly placed core at the outside surface thereof or the surface most remote from the axis of the turret.

The method by which the turret winder of the general type shown in Penrod was operated required the cores to be loaded at the roll changing or unloading station and this generally impeded the automation of the loading and unloading of such turret winders. It has, however, in recent years, become desirable to automate both the loading of the cores into the winder and the unloading of completely wound rolls from the winder, and the necessity of having to accomplish each of these functions essentially at the same station resulted in a complication, and further resulted in the necessity of having present at that station two substantially different kinds of handling equipment. Generally it was not possible to load cores into the arms of the turret at the web transfer station due to the fact that the web was running off of the roll changer and onto the winding roll along a path outside of the rotational orbit of the arms, and thus stood in the way of bringing cores up from a magazine of cores or the like and onto the unloaded spindles at the web transfer station.

Thus, there exists a need for a winder for handling web materials of the kind described above in which a pressure roll maintains continuous contact with the winding roll throughout the complete winding and roll change sequence, and in which the web always contacts the pressure roll at or prior to the winding nip, preferably with a partial wrap of the web about the pressure roll, throughout the entire winding process.

SUMMARY OF THE INVENTION

In one aspect of the invention, a turret-type winder pivotally supports a pair of pressure roll arms, with self-contained pressure rolls mounted on the remote ends of such arms. The pressure rolls are arranged to engage the web of material at or prior to the nip of the material with the building roll. They maintain this relationship throughout indexing movement carrying the core and the building roll therefrom from a loading station to a roll unloading station, and throughout the remainder of the build-up, without any substantial change in the position of the pressure roll on the roll surface, so that air is effectively excluded at the nip and the roll is formed with uniform hardness.

In the preferred construction of the turret, primary arms support core chucks or spindles at their remote ends, for supporting cores onto which the web of material is sequentially wound, the turret further is provided with a pressure roll mounting means in the form of a mounting plate which, in turn, pivotally supports, on each side of the machine, pressure roll arms carrying pressure rolls at one end thereof, and preferably carrying counterbalancing auxiliary guide rolls at their opposite ends. The position of the arms are regulated by suitable fluid motors connected to the pressure roll mounting plate.

As noted above, in conventional turret-type winders, the web path to the winding roll, as the turret is indexed, falls outside of the path of the returning arms carrying the fresh core, and this dictates the direction of rotation when the web is severed and applied to the new core by the enveloper structure, and also dictates the optimum placement of the pressure roll. This difficulty is overcome by returning the empty arms from which a freshly wound roll has been removed to the web cutting station adjacent the roll changer prior to the insertion of a new core, by passing the free ends of the arms through the path of the web and thereby placing the ends of the arms on the opposite side of the web. Now, a new core may be loaded by a suitable core loader at the roll changer. When the web is severed and applied to the new core, it is applied on an inside surface of the core, that is, to a surface inwardly of the rotational axis of the core as distinguished from the surface radially outwardly of the rotational axis. The core rotates in a direction opposite of that of the conventional arrangement. A self-contained pressure roll carried by the turret on spindle supporting arms is positioned to engage the on-running web in very close relation to the nip or immediately above the nip, which position is the most effective for excluding air from the successive wraps.

The invention thus permits the loading of new cores at the web cutting station adjacent the roll changer. This has the additional advantage of providing for an improved flow of materials at the winder. The new cores may be stored in a magazine associated with or adjacent to the roll changer and completely out of the way of the handling equipment necessary to receive and remove the fully wound or completed rolls at the unloading station. It also enhances the automation of the loading of cores on the spindle.

The individual pressure rolls and the auxiliary guide rolls mounted on the turret are mutually interconnected through a belt system so that each rotates in the same direction, driven by whichever one of the two pressure rolls is in contact with the winding roll. In this manner, during transfer following the severing of the web, the pressure roll is already substantially at the surface speed of the new core, and may be brought into full pressure contact with the web and the core without disrupting the on-running web. The system of interconnecting belts or drives for the pressure rolls and auxiliary rolls includes a torque-limiting clutch in the event that the surface speed of the new core is not exactly the same as the web speed. This difference may be occasioned by variations in the diameters of the cores, which, for example, may vary between 0.030" and 0.060" from one other.

The improved turret winder apparatus of the present invention is designed particularly to take full advantage of the adhesive web transfer and cutting apparatus as disclosed and claimed in the co-pending application of Tetra, Ser. No. 325,445 filed on even date herewith. In that application, which is incorporated herein by reference, method and apparatus are disclosed by means of which a moving web may be transferred to a fresh core and severed on a relatively stationary knife, without fold-back, and without the use of auxiliary enveloping rolls, pusher bars or the like. As more fully described in the co-pending Tetro application, an adhesive strip or the like is formed or applied along the surface of the core, and the pressure roll with the web running therepast in contact with the pressure roll, is brought to a position closely adjacent to but not contacting the new core, which now is rotating substantially at web speed. When the cut and transfer is desired, the remaining distance between the pressure roll and the core is closed. A relatively stationary serrated knife as previously been brought into close proximity with the web. As the core rotates, the engagement thereof by the strip of adhesive causes a temporary deflection of the moving web into the serrated teeth of the knife, and the force of engagement of the web by the knife, coupled with the increased tension between the engaged knife at the winding roll, caused by the inertia of the winding roll causes the web to penetrate the knife and be automatically severed with the cut edge rolled onto the core substantially at the adhesive line without fold-back. Thus the web transfer onto the new core is accomplished without the use of complicated timing mechanisms and is accomplished without the use of auxiliary enveloping rolls, pusher bars or other web-engaging apparatus, and the adhesive which secures the cut edge of the web to the new core is the same adhesive which caused the temporary deflection of the moving web onto the cutting knife. After severing, the knife which is preferably associated with the roll changer apparatus, is retracted from its cutting position and placed into a storage position. In this manner, the turret mechanism is substantially simplified and the relative cost is reduced, as compared to conventional roll changer and turret mechanism for continuous winding.

Another aspect of the invention includes an improved method of winding relatively impervious sheet-like material on a turret-type winder which includes the novel steps of bringing the unloaded turret arms through the path of the web so that the ends of the turret arms which will support the new core extend to the opposite surface of the web with the web leading between the arms. Thereafter the new core is loaded at the web cutting station, and when the web is cut it is applied to the rotating core on the side of the core nearest to the spindle axis of the turret and is engaged on the same side by a pressure roll carried on the turret. The pressure roll engages the web preferably just prior to forming a nip with the core, and maintains this position throughout the indexing of the turret winder to place the building roll at an unload station and continues to maintain this relative position throughout the building of the roll to its maximum diameter.

It is therefore an important object of this invention to provide a turret winder which includes self-contained pressure rolls positioned to engage a building roll such as substantially to exclude all of the air entrained by the web into the convolutions, and positioned to maintain this engagement throughout the indexing movement of the turret.

Another important object of the invention is the provision of a winder including a turret for supporting a plurality of spindles thereon in which the spindle arms are proportioned to move through the path of the web leading to a building roll on the turret to a core loading station, which station is at a side of the web opposite from the turret. In addition, the invention includes the object of cooperating with a core loader at a side of the winder opposite from the unloading station to place new cores in the winding spindle at the opposite side of the web.

Another object of the invention is the provision of a self-contained turret winder with pressure roll mounting arms pivotally carried at pivot points which are fixed in relation to the primary arms, and which support one pressure roll for each winding spindle, on one end of the arms, and which further support counterbalancing auxiliary rollers at the opposite ends of the arms, which auxiliary rollers serve to guide the web to an adjacent pressure roller during and following indexing of the turret arms carrying the new building roll from the loading station to the unloading station.

A still further object of the invention is the provision of a turret in which the primary and secondary rollers are joined together in a uniform low-friction drive, such as a belt drive, so that each of the rollers is driven in the same direction by one of the pressure rollers being in contact with a building roll.

Another object of the invention is to provide a winder apparatus which is particularly adapted to use and take advantage of the adhesive web cutting and transfer apparatus and method of the above-identified co-pending application of Tetro Ser. No. 325,445.

A still further object of the invention is the provision of a method for winding a web, particularly a web of relatively impervious material, such as plastic, in which a pressure roll is carried on a turret and is arranged to engage the winding roll at all times from the beginning to the completion of the wind, from initial engagement of the web with a newly placed core, through the indexing movement of the turret, to the completion of the roll or roll package at the unloading station.

A further object of the invention is the provision of a method of winding a roll, as outlined above, in which the unloaded turret arms are caused to pass through the path of the web leading to a winding roll so that the core-receiving spindle is positioned at the opposite side of the web, providing among other things for the automatic loading of cores onto the spindle ends without interference with the moving web and providing for the engagement of the web with the new core at a surface inside the turret, rather than at a surface of the core outside the turret, thus permitting the use of a self-contained pressure roll on the turret which may engage the web just prior to or at the nip of the web with the roll, and maintaining this relationship throughout the entire winding process.

These and other objects and advantages of the invention will be apparent from the following description, the accompanying drawings and the appended claims.

DESCRIPTION OF PREFERRED EMBODIMENT

Figure 1:
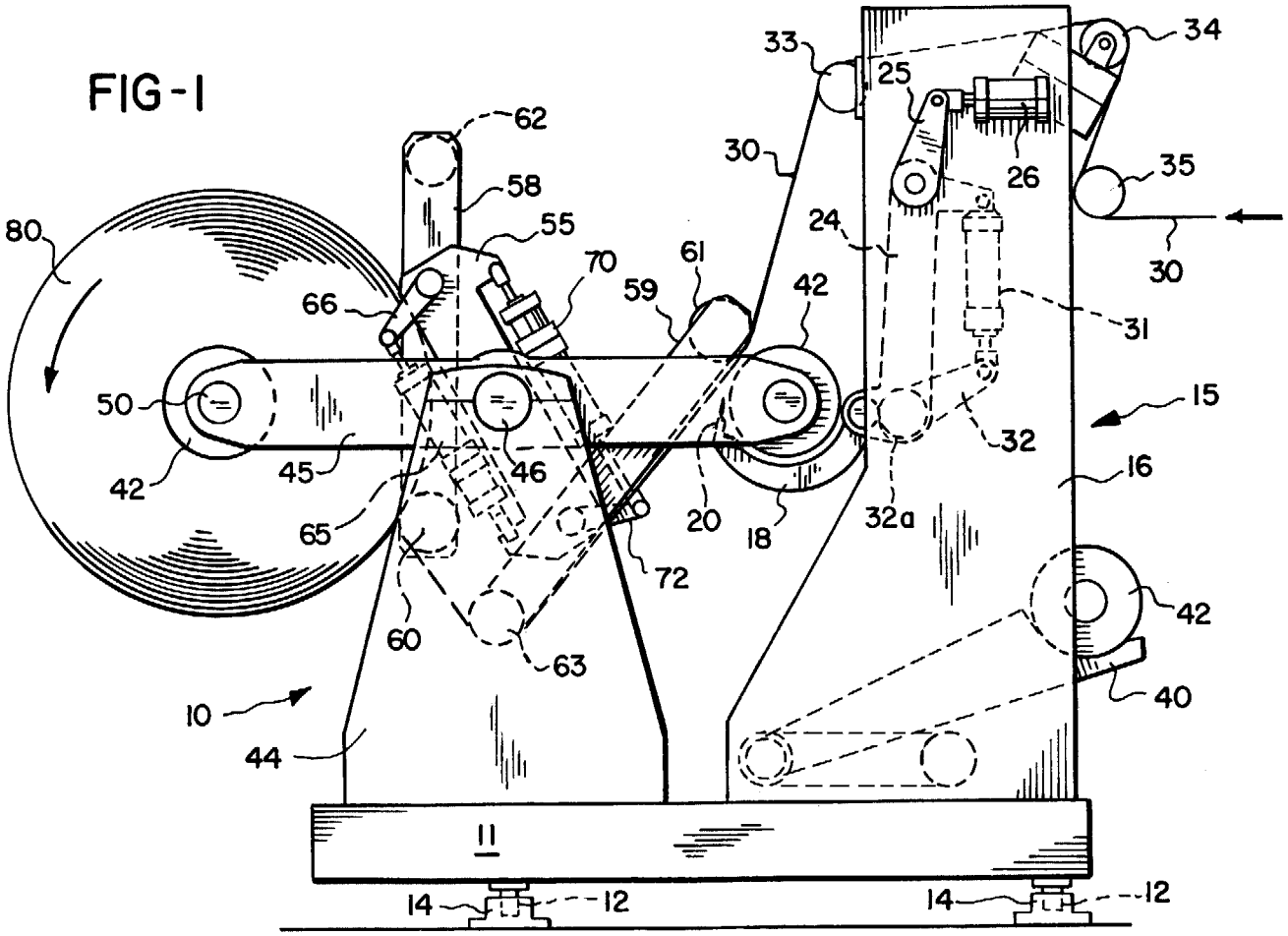
FIG. 1 is a side elevational view of a turret winder according to the invention, shown in combination with a roll changer.

Referring first to FIG. 1, a turret winder constructed according to this invention is illustrated generally at 10 as being mounted on a side lay base 11, which in turn, supports underlying rollers 12 mounted on transversely oriented rails 14. The side lay base also supports a roll changer illustrated generally at 15. The roll change 15 includes side frame members 16 which support an articulated cut-off knife arm 18 which has, at its terminal ends, a serrated knife 20. The knife 20 may be of the kind more fully and completely described in the above-identified co-pending application of Tetro filed on even date herewith, and in the co-pending application of Phelps and Tetro, Ser. No. 165,301 filed July 20, 1980, now U.S. Pat. No. 4,326,679 issued Apr. 27, 1982.

The knife arm 18 is pivotally mounted at 22 to a primary support arm 24, and the primary support arm 24 is operated through an operating arm 25 by a fluid motor 26. The knife arm 18 and associated knife 20 is brought up into a position adjacent the web 30 by a secondary fluid motor 31 acting through an arm 32 and intermediate gearing 32*a* to bring the knife into a relatively stationary position for web severance and transfer as hereinafter described in greater detail.

The roll changer 15 includes a guide roll 33 which guides the web off of the roll changer, a tension roll 34 which may be operated in a conventional manner to set a desired tension into the web, and a lead-in roll 35. The roll changer 15 further includes core leading apparatus in the form of a pivotally mounted core loading arm 40, shown in FIG. 1 in a retracted position to receive thereon a core 42 from a magazine of such cores, not shown.

The turret winder of this invention, as illustrated generally at 10 in FIG. 1, includes a pair of transversely spaced pedestals or end stands 44 which, in turn, rotatably support a pair of transversely spaced primary turret arms 45 about a main shaft 46 defining the axis of rotation of the turret. Portions of the turret described above including the end stands 44, the primary roll supporting arms 45, and the main shaft 46 may be constructed essentially as shown by the corresponding parts in the U.S. Patent of Penrod, No. 3,478,975, mentioned above. It is understood that the turret 10 also includes a drive, not shown, by which the turret arms are rotated or indexed, to move the ends of the arms, in a known manner, between a core loading station indicated generally by the letter A and an opposite roll unloading station indicated generally by the letter B. The turret winder also carries a core shaft drive motor on one of the arms by which the end spindles and cores are driven in a known manner.

Each of the opposite ends of the turret arms 45 are conventionally provided with core-receiving spindles or core chucks, for the purpose of supporting the cores 42 in the chucks between the arms. Either rod-type or rodless chucks may be used as is well known in the art. A preferred form of core chuck 50 may be that shown in detail in the prior U.S. Patent of Phelps, et al, No. 3,841,577 issued Oct. 15, 1974, as identified by the reference numeral 60 in FIG. 4 and by the reference numeral 80 in FIG. 5 of that patent, and the spindle drive may be in accordance with the drive mechanism as illustrated and described in that patent. Thus, the spindles at the ends of the arms 45 are movable inwardly to engage and support the core 42 and may be retracted for unloading purposes. When the core 42 is not in place, an open or free space exists between the parallel arms 45 which substantially exceeds the width of the web 30.

The turret 10 also includes a pair of transversely spaced pressure roll mounting plates 55. The mounting plates 55 are positioned immediately inboard of the transversely spaced arms 45 on the shaft 46, and are fixed to the shaft at an angle of approximately 70° to the arms 45, and thus rotate with the shaft 46 and the arms 45. The pressure roll mounting plates 55 extend to opposite sides of the main shaft 46 and at a region adjacent their ends and pivotally support pairs of transversely spaced pressure roll arms 58 and 59. Only one of the arms 58 and 59 is shown, it being understood that corresponding arms are associated with the pressure roll mounting plate on the transversely opposite side of the turret.

The arms 58 rotatably support a freely rotating pressure roll 60 therebetween and similarly, the arms 59 support an identical freely rotating pressure roll 61. The diametric opposite ends of the pairs of arms 58 and 59 also respectively support freely rotating counterbalancing guide rollers 62 and 63 therebetween. The position of the pairs of arms 58 and the amount of force applied by the associated pressure roll 60 is controlled by a fluid motor 65 having one end connected through a lever arm 66 to the pivot shaft 67 of the arms 58. Similarly the pairs of arms 59 and the pressure roller 61 thereon are controlled by a fluid motor 70 connected to the pressure roll mounting plate 55 and to a lever arm 72 which is connected to the adjacent arm 59 through the arm pivot shaft 74.

Figure 9:
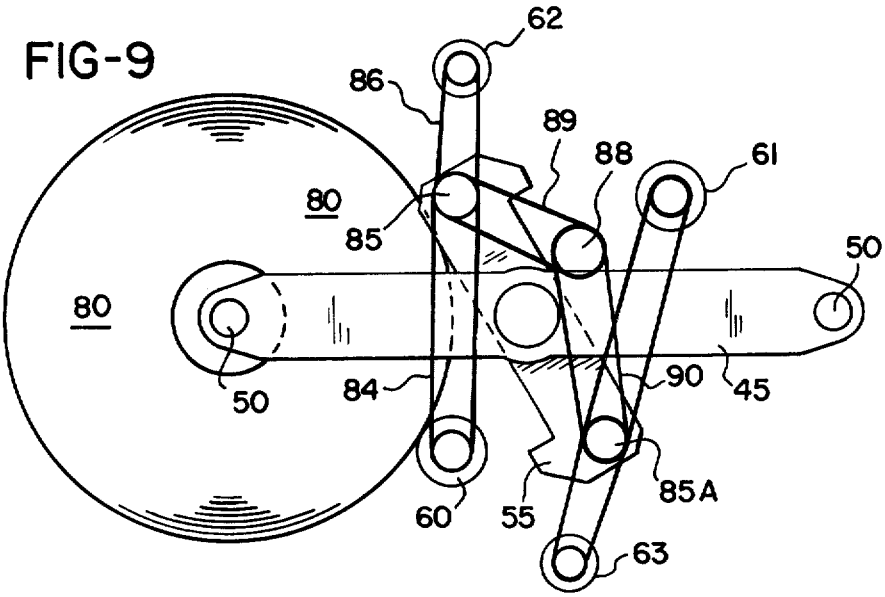
FIG. 9 is a diagram of the power train interconnecting the pressure and auxiliary rolls.

It is important that the pressure rolls 60 and 61 and the auxiliary or guide rolls 62 and 63 be rotating in the same direction essentially at web speed to prevent undue disruption of the web when any of these rolls come into contact with the web, and particularly when a pressure roll first comes into contact when a web is being transferred to a new core. A typical drive arrangement is diagramed in FIG. 9, where the pressure roller 60 is shown in surface contact with a building roll 80 and accordingly is rotated at surface speed. Belting 84 from the roll 60 drives an idler 85 at the pivot shaft 67 of the mounting plate 55, and the guide roller 62 may be driven by corresponding belting 86. The idler 85 drives a corresponding idler **85*a* at the opposite end of the pressure roll mounting plate through an intermediate torque limiting clutch 88 and belting 89 and 90. The idler 85*a* operates in the manner of the idler 85 and in turn drives the pressure roll 61 and the idler 63 in the same direction and essentially at surface speed. The purpose for the torque limiting clutch 88 is to assure that slight variations or differences in the diameters of the cores will not cause a disruption or momentary surge or variation in the tension of the web 30. For example, new cores are known to vary from each other slightly in diameter, and the speed of rotation of the cores, as driven by the spindle drive motor may not correspond exactly to the free turning speed of the adjacent pressure rolls 60 or 61 at the moment that it comes into contact with the core. The torque limiting clutch 88 prevents this differential from being applied throughout the roll driving apparatus shown in FIG. 9** and effecting tension in the web.

In the operation of the improved turret of this invention and in the practice of the method thereof, a web 30 which may consist of air impervious material such as plastic, is applied to the roll changer 15, under the guide roll 35, over the tension roll 34 and over the guide roll 33, for application to the turret winder 10. In the view as illustrated in FIG. 1, a winding roll 80 is shown as being located at the roll unloading station B and is approaching its maximum diameter. A new core 42 has been loaded on the opposite spindles 50 of the arms 45 and is awaiting web transfer.

The sequential views of FIGS. 2 through 8 are useful in following the sequence of operation of the apparatus and the steps of the method of the present invention. As previously noted, FIG. 1 shows a new core in place on the spindle arms at station A with the web 30 being wound on the building roll 80 at station B. This web has a generally downward lead, and in the position shown in FIG. 1, is already in engagement with the pressure roll 61 on the arms 59, with the web being spaced a very short distance away from the new core 42. The knife 20 mounted on the arm 18 has been raised to a relatively stationary cutting position between the web lead off the roll 61 and the adjacent surface of the core.

As noted above, the web cutting and transfer apparatus of the present invention is preferably that shown and described in the co-pending application of Tetro filed on even date herewith. In that application, a transversely oriented strip or ayer of adhesive has been applied to the outer surface of the core 42, and thus is rotating with the core. Upon signal, the pressure roll 60 urges the web into pressure engagement with the core 42, thus carrying the web 30 against the core surface. As the core continues to rotate, the adhesive thereon picks up the web and draws it slightly downwardly into engagement with the serrated teeth of the knife 20. The increase in tension of the web causes the web to be severed on the knife, and the cut leading edge of the web remains applied to the core 42 by the adhesive without foldback. The cut trailing edge of the web is shown at **30*a* in FIG. 2 and will, by reason of the rotation of the roll 80, be carried onto the roll. At this point, the knife 18 is quickly lowered or retracted to the broken line position shown in FIG. 2 by the fluid cylinder 31, to be out of the web of the web material now building on the new spindle core 42**.

It is important to note that the self-contained pressure roll 61 of the arms 59 engages the web 30 substantially at the nip of the web with the core 42, and preferably at a region somewhat ahead of the forming of the nip by the web 30 on the core and the building roll, so that the web 30 partially wraps the pressure roll 61 prior to forming the nip. In this manner, the air which would otherwise be trapped between convolutions is effectively excluded prior to any possibility of the same being entrapped. The amount of force of the pressure roll 61 against the core and the building web may be controlled by the associated fluid piston motor 70 carried on the plate 55.

Figure 2:
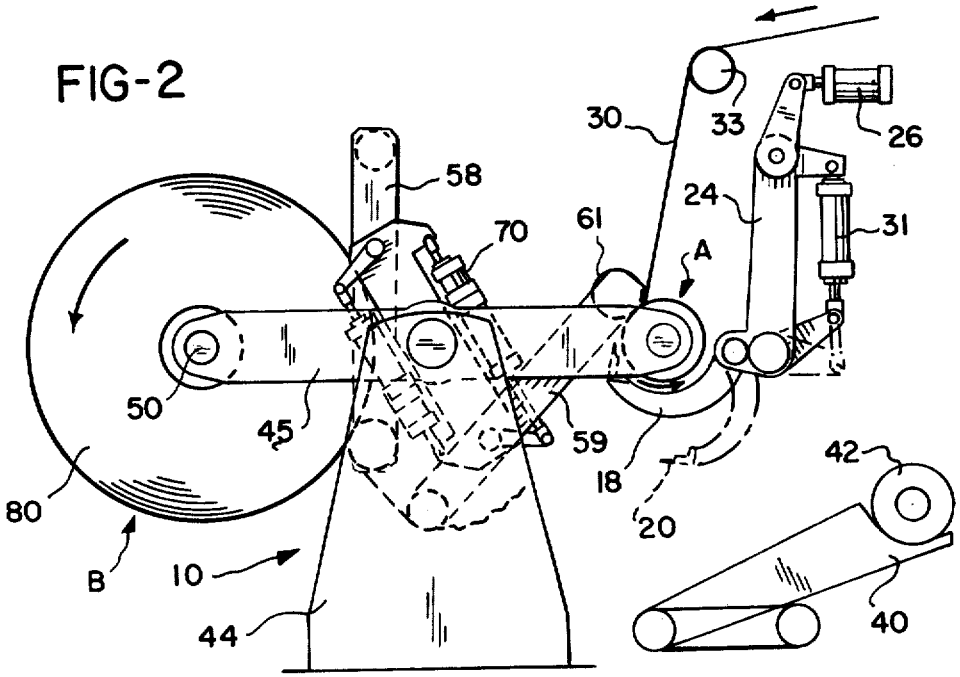
FIG. 2 is a somewhat reduced side elevational view of the turret winder of FIG. 1; illustrating the moment of web serverance and transfer to a new core.
Figure 3:
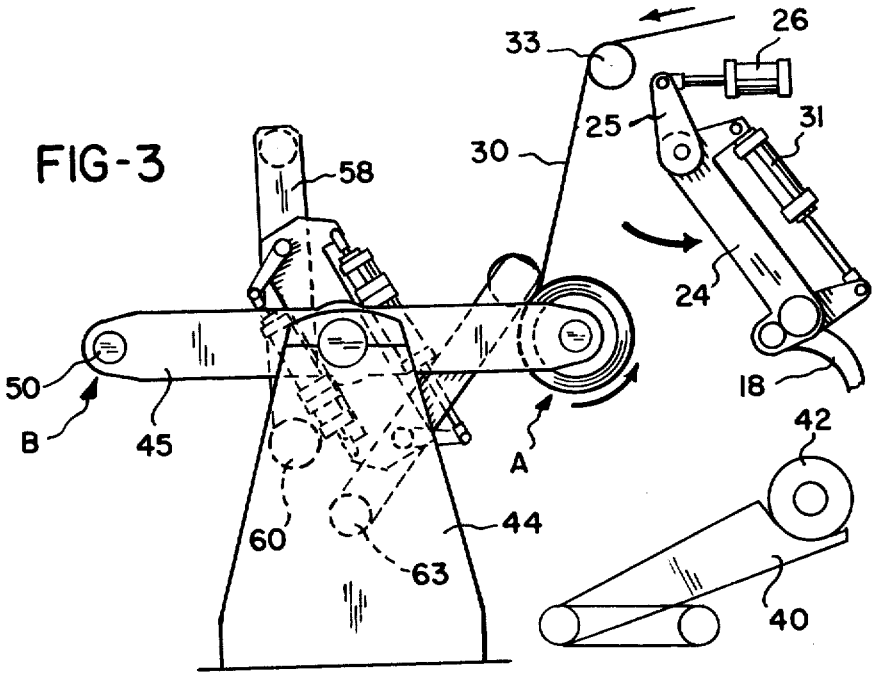
FIG. 3 is a view of the winder similar to FIG. 2 showing the building of a new roll on the core and the removal of the completed roll from the opposite end of the primary turret arms.

The web may be permitted to build somewhat in the station A as shown in FIG. 2. The knife arm 18 is now fully retracted by the fluid motor 26 as shown in FIG. 3, and the fully built-up roll 80 has now been removed from the turret arms 45 by suitable handling equipment. Note that contrary to conventional practice, a new core is not loaded on the unloaded spindles 50 at station B.

Figure 4:
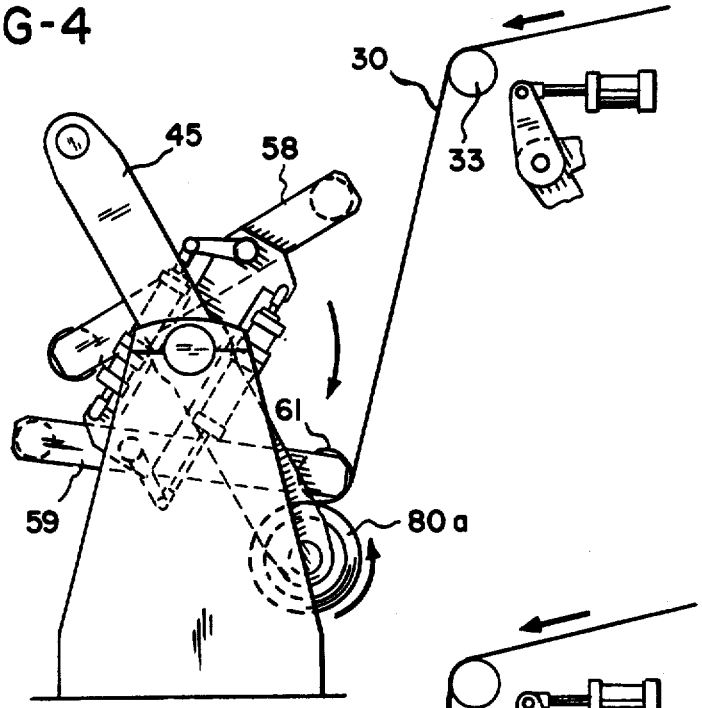
FIG. 4 is a further view of the turret winder of this invention showing the initiation of turret indexing.

Referring to FIG. 4, the turret 10 may be indexed by its primary indexing motor by rotation in a clockwise direction as shown in FIG. 4 accompanied by a lowering movement of the building roll, drawing out a further lead of the web 30 from the guide roll 33. About 60° of initial movement is shown in FIG. 4.

Figure 5:
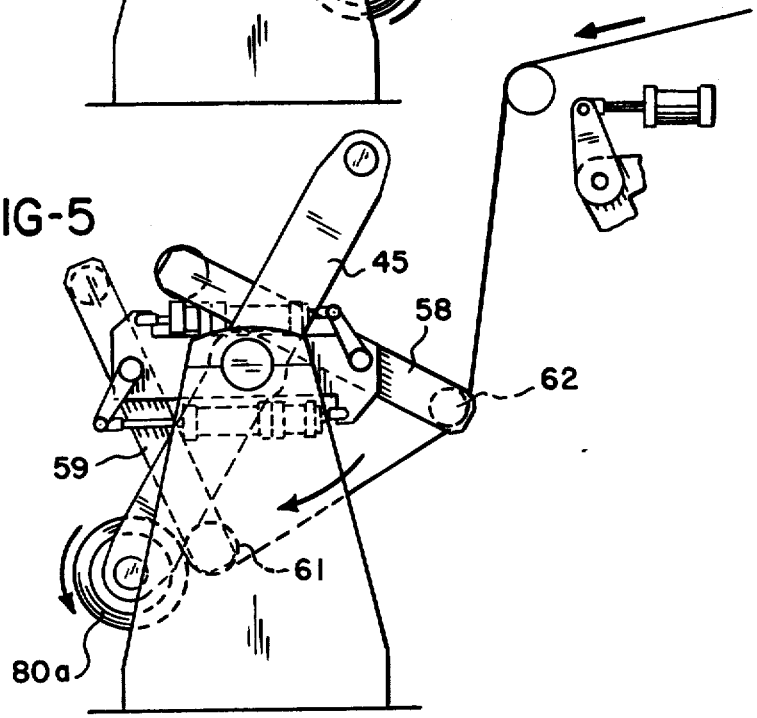
FIG. 5 is a view similar to FIG. 4 showing a further step in turret indexing where the web has been contacted by one of the auxiliary rolls.

FIG. 5 shows the same apparatus after about 120° of rotation. Note that the free guide roller 62 carried by the primary roll supporting arms 58 has now engaged the relatively longer lead of the web 30 from the guide roller 33, and has deflected the same somewhat downwardly to assure that the web clears all of the motor apparatus carried by the turret. Also note in both FIGS. 4 and 5 that the pressure roller 61 carried on the arms 59 has not substantially altered or changed its air excluding contact position with the new building roll **80*a***, which position was established at the time of web transfer.

Figure 6:
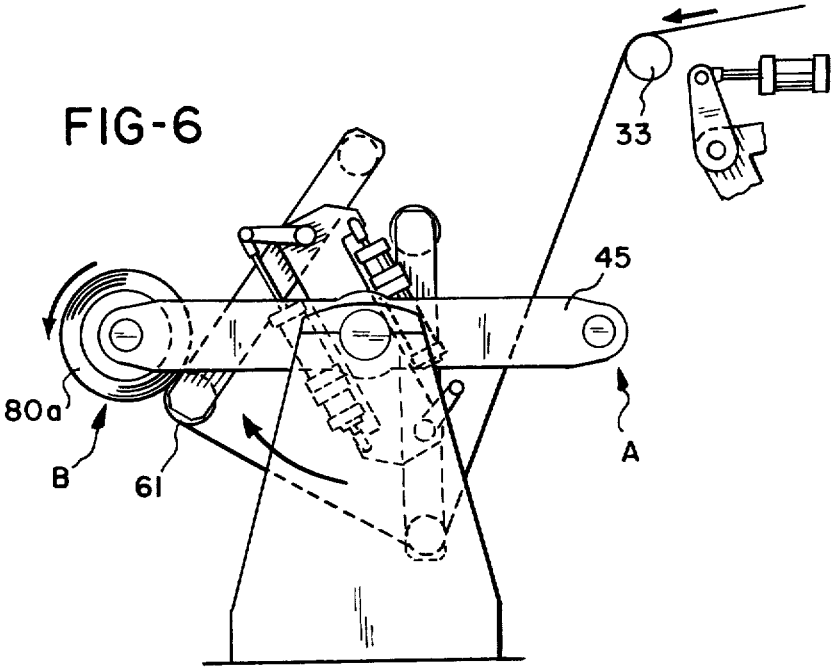
FIG. 6 shows the turret winder after having completed 180° of indexing and the open spindle arms on the other end have been brought through the web lead-in path.

FIG. 6 now shows the turret having indexed through approximately 180°. The now empty primary arms 45, which formerly carried the roll 80, have now passed through the path of web lead from the guide roll 33, and that the web 30 is moving between the free ends of the primary turret arms 45 inwardly of the spindle axis, between the spindle axis and the turret axis. The pressure roll 61 on the arms 59 continue to engage the newly building roll **80*a*** prior to the formation of the nip, thus essentially maintaining the geometry of winding.

Figure 7:
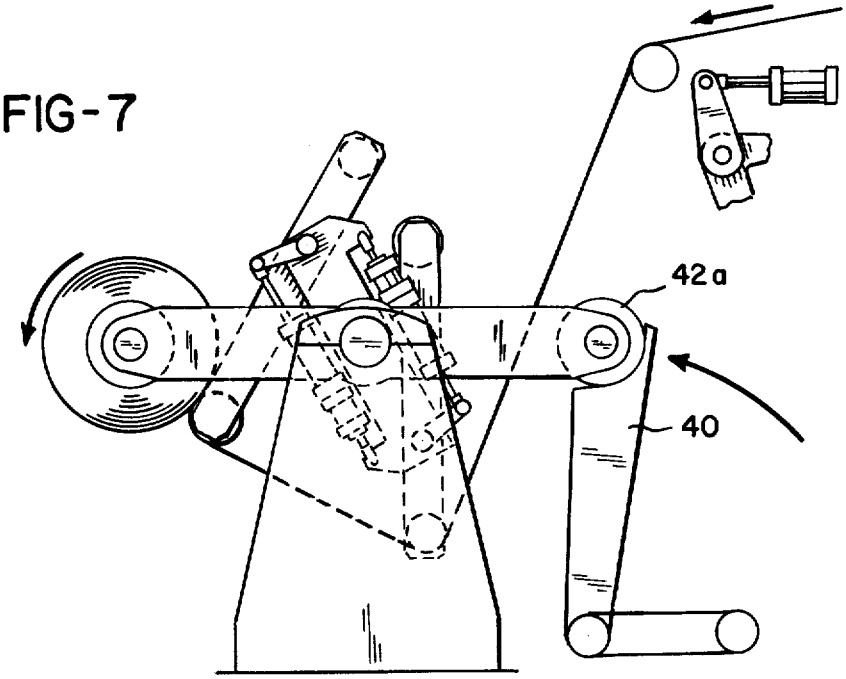
FIG. 7 is a further view of the turret winder illustrating the insertion of a new core in the spindle arms.
Figure 8:
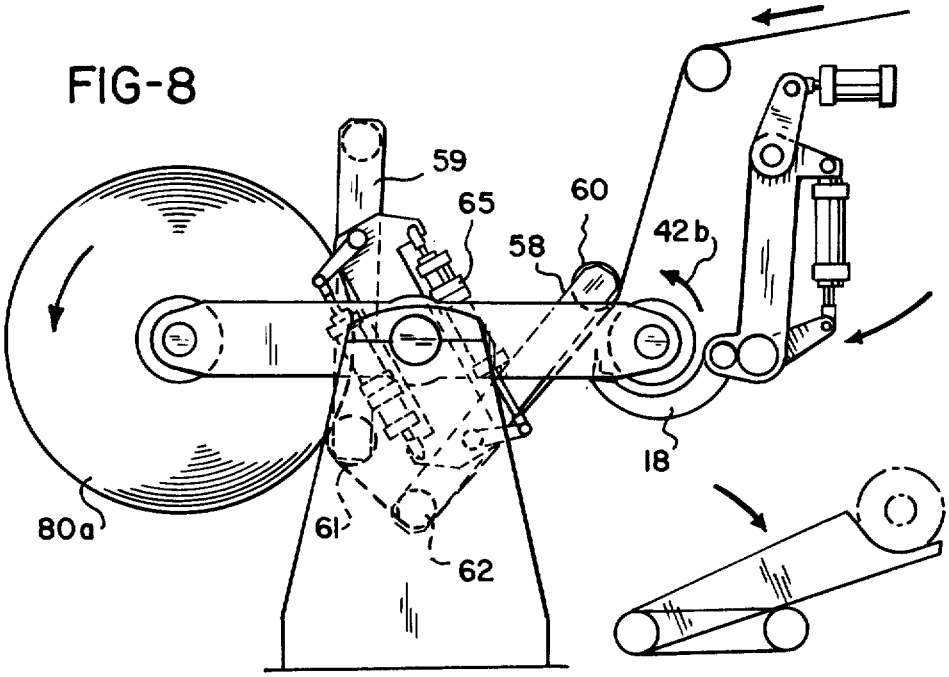
FIG. 8 shows the winding almost completed, prior to web severance and attachment to the newly loaded core.

The indexing of the turret may be terminated at this position while the new winding roll **80*a* builds as shown in FIG. 7. At an appropriate time, not critical, a newly prepared core 42*a* may be loaded into the chucks or spindles 50 at the station A by the core loading arms 40, as shown in FIG. 7, and thereafter the fluid motor 65 controlling the position of the pressure roll supporting arms 58 may be moved to index the associated pressure roll 60 into a "ready to transfer" position as shown in FIG. 8, accompanied by a slight displacement of the counterbalancing guide roller 62 carried on the opposite end thereof. The preferred geometry of pressure roll 61 on the newly winding roll 80*a*** is maintained.

The illustration of the parts shown in FIG. 8 prior to cutting and transferring the web to the new core **42*a* is essentially that shown in FIG. 1 except the parts have now been rotated through approximately 180° from that shown in FIG. 1, and this position may be maintained until the newly building roll 80*a* has reached the desired diameter, at which point the pressure roll 60 brings the moving web 30 into contact with the newly placed core 42, and a web severance and transfer takes place as previously described. Note in FIG. 8 that the web lead from the guide roll 33 is to a side of the newly placed core 42*a* between the axis of the core-supporting spindle and the axis of the turret itself. The core 42*a* will be rotating in the direction of the arrow 42*b* and the web will be wrapped first downwardly outwardly and then upwardly in a counterclockwise manner as viewed in FIGS. 1 and 8**.

It will accordingly be seen that the method and apparatus of the present invention eliminates the need for primary pressure rolls on a roll changer, thus permitting a reduction in the cost and complexity of the equipment.

While the turret apparatus and method of the present invention is designed to take full advantage of the no fold-back web cutting and transfer method disclosed in the above defined co-pending application of Tetro filed on even date herewith, the invention should not be understood as being limited to this particular form of no fold-back web cutting and transfer method, and conventional roll enveloping equipment may be used, or alternatively, the pusher bar and stationary knife combination of co-pending application Ser. No. 165,301 filed July 20, 1980 by Phelps and Tetro may be used.

Since the newly placed cores 42 are not loaded at the roll unloading station B, as is conventional practice, but rather are loaded at the station A, the invention also permits the orderly arrangement of cores in a magazine associated with a roll changer or the like physically remote from the relatively heavier transport equipment which must be in position at station B to receive the fully wound rolls.

Throughout the winding process, the pressure roll 60 or 61 at all times engages the lead-in web on the building roll at or prior to the formation of the nip, preferably with at least some wrap of the web about the pressure roll. This effectively excludes air from being entrapped between the convolutions, and provides an arrangement by which the hardness of the roll may be maintained throughout the complete package. Side-shifting of the successive layers during turret indexing and web transfer is substantially reduced or eliminated.

In the preferred embodiment of the invention, the guide rollers 62 and 63 are shown as being mounted on the remote ends of the respective arms 58 and 59, which is of particular advantage in that the guide rollers also serve to counterbalance these arms. However, it would be within the scope of the invention to apply to guide rollers to an extension of the plates 55, and use conventional arm counterbalancing beams as illustrated by the beams 83 of the patent of Penrod, U.S. 3,478,975, previously identified.

While the method herein described and the form of apparatus for carrying this method into effect constitute preferred embodiments of this invention, it is to be understood that the invention is not limited to this precise method and form of apparatus, and that changes may be made in either without departing from the scope of the invention.

I claim:

1. An improved turret-type winder including a winder stand and roll-supporting turret arms mounted on the stand having spindle ends adapted to support cores thereon for winding rolls thereon, the improvement comprising:

means on said turret arms forming a pressure roll mount, a pair of pressure roll arms pivotally mounted on said pressure roll mount, one for each of said spindle ends, each of said pressure roll arms rotatably carrying a pressure roll on one end thereof, said pressure rolls on said arms being pivotally movably into contact with a core and with a winding roll on a core at a location in relation to the axis of the core inwardly thereof on the side thereof toward the axis of the turret so that a web leading onto said core from a roll changer or the like contacts the associated said pressure roll at or prior to winding thereof on the winding roll for effectively excluding entrapped air prior to forming of convolutions on the roll.

2. The turret-winder of claim 1 further comprising auxiliary guide rolls one each mounted at the remote end of said pressure roll arms opposite said pressure rolls providing for the guiding of a web under pressure contact by the pressure roll of the other of said arms.

3. In a turret-type winder for continuously winding a web of material, including stands supporting a transverse main shaft, a pair of turret arms on the main shaft having spindles at their remote ends for receiving transversely oriented cores thereon, onto which a web of sheet material is to be continuously wound, each of said turret arms including means defining secondary arm support plates associated therewith, each carrying a pair of pivotally mounted secondary arms with their remote ends extending on either side of said support plates, the improvement comprising:

a primary web guiding and pressure roll carried on one of the remote ends of each of said secondary arms, each of said primary pressure rolls being movable into engagement with one of said cores and the winding rolls formed on said cores while maintaining a relative position on said winding roll throughout its minimum to maximum diameter with the lead-in web in a partially wrapped condition on said pressure roll as said turret is indexed to carry the winding roll from a cut-off station through approximately 180° to an unloading station, a pair of auxiliary rolls, one each supported on the opposite ends of said secondary arms remote from said pressure rolls, and means interconnecting said primary and auxiliary rolls to be rotated together at the same speed by the engagement of one of said pressure rolls with a building roll on said turret arms.

4. The method of operating a turret-type winder in which a pair of roll-receiving spindles are carried on the opposite ends of a pair of turret arms which are indexed through approximately 180° for the winding of a roll on a core mounted on said spindles, comprising the steps of:

providing a web lead path to a core on one end of said arms at a position between said core and the turret axis, rotating said core in the direction to cause said web to be wrapped from the inside surface thereof, indexing said turret arms while continuing to wrap a building roll on said core to a 180° roll unloading position and simultaneously bringing the empty turret arms at the outer end of said turret through said web path so that the spindle ends of said empty arms are positioned on the side of said web path opposite said building roll, pressing the web at the point of tangency to the building roll throughout the building of the web and in all indexed positions of said turret arms, and loading a new core on said empty turret arms.

5. The method of operating a turret-type winder in which roll-receiving spindles are carried on the opposite ends of a pair of turret arms which are indexed through approximately 180° for the winding of a roll on a core mounted on said spindles, comprising the steps of:

providing a web lead path to a core on one end of said arms at a position between said core and the turret axis, applying said web to said core while rotating said core in a direction to cause said web to form a nip at a surface of the core between the spindle axis and the turret axis, applying pressure to the web at the point of tangency to the building roll on said core, indexing said turret arms while continuing to apply said pressure to said a building roll and moving said roll to a roll unloading position, and completing the winding of said web on said roll while maintaining said pressure at said nip.

* * * * *